US009822794B2

(12) United States Patent
Yamamoto

(10) Patent No.: US 9,822,794 B2
(45) Date of Patent: Nov. 21, 2017

(54) FAN COVER HAVING VIBRATION SUPPRESSING MECHANISM OF FAN MOTOR, AND MOTOR DRIVE UNIT

(71) Applicant: FANUC CORPORATION, Yamanashi (JP)

(72) Inventor: Kazuhiro Yamamoto, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 14/321,869

(22) Filed: Jul. 2, 2014

(65) Prior Publication Data

US 2015/0016987 A1 Jan. 15, 2015

(30) Foreign Application Priority Data

Jul. 3, 2013 (JP) ..... 2013-140006

(51) Int. Cl.

| | |
|---|---|
| ***F04D 29/52*** | (2006.01) |
| ***F04D 19/00*** | (2006.01) |
| ***F04D 29/32*** | (2006.01) |
| ***F04D 29/64*** | (2006.01) |
| ***H02K 5/24*** | (2006.01) |
| ***F04D 29/70*** | (2006.01) |

(52) U.S. Cl.

CPC ..... *F04D 29/522* (2013.01); *F04D 19/002* (2013.01); *F04D 29/703* (2013.01)

(58) Field of Classification Search

CPC ..... H02K 5/00; H02K 5/24; F04D 19/002; F04D 29/522; F04D 29/646; F04D 29/668; F04D 29/325; F04D 29/40; F04D 29/52; F04D 29/60; F04D 29/64; F04D 29/642; F04D 29/644

See application file for complete search history.

(56) References Cited

U.S. PATENT DOCUMENTS 6,215,659 B1 * 4/2001 Chen ..... G06F 1/20 165/122
6,711,015 B2 * 3/2004 Syring ..... H01L 23/467 165/80.3

(Continued)

FOREIGN PATENT DOCUMENTS

CN 1892049 A 1/2007
CN 101847927 A 9/2010

(Continued)

OTHER PUBLICATIONS

English Abstract and Machine Translation for Chinese Publication No. 101847927 A, published Sep. 29, 2010, 6 pgs.

(Continued)

*Primary Examiner* — Nathaniel Wiehe
*Assistant Examiner* — Brian O Peters
(74) *Attorney, Agent, or Firm* — Fredrikson & Byron, P.A.

(57) ABSTRACT

A fan cover (10), on which a fan motor (11) is mounted, includes: a fan cover flat portion in which an opening portion (12) is formed; a protruding portion (13) extending from the fan cover flat portion around the opening portion; and a supporting portion (14), which is arranged on the protruding portion, for supporting the fan motor, wherein a distance between the fan cover flat portion and the supporting portion of the protruding portion is smaller than the thickness of the fan motor.

4 Claims, 8 Drawing Sheets

(56) References Cited

U.S. PATENT DOCUMENTS

| | | | | |
|---|---|---|---|---|
| 6,822,864 | B2 * | 11/2004 | Huang | H01L 23/4093 24/457 |
| 7,048,498 | B2 * | 5/2006 | Kosugi | F04D 29/601 415/118 |
| 7,230,826 | B2 * | 6/2007 | Kyle | H05K 7/20172 165/122 |
| 7,281,893 | B2 * | 10/2007 | Pan | F04D 29/601 165/80.3 |
| 7,597,535 | B2 * | 10/2009 | Wu | F04D 29/601 415/119 |
| 7,895,843 | B1 * | 3/2011 | Hawkins | F25D 17/065 62/340 |
| 2002/0060900 | A1 | 5/2002 | Qiu | |
| 2004/0007010 | A1 * | 1/2004 | Kopf | F04D 29/646 62/419 |
| 2004/0173339 | A1 * | 9/2004 | Cheng | F04D 29/582 165/121 |
| 2008/0008576 | A1 * | 1/2008 | Hong | F04D 19/007 415/68 |
| 2008/0180911 | A1 * | 7/2008 | Kaneko | F04D 25/0613 361/695 |
| 2012/0087790 | A1 | 4/2012 | Zeng et al. | |
| 2014/0112771 | A1 * | 4/2014 | Li | F04D 29/646 415/214.1 |

FOREIGN PATENT DOCUMENTS

| | | | |
|---|---|---|---|
| JP | 6314899 | U | 1/1988 |
| JP | 05003596 | A | 1/1993 |
| JP | 05168188 | A | 7/1993 |
| JP | 2006049672 | A | 2/2006 |
| JP | 2012237593 | A | 12/2012 |

OTHER PUBLICATIONS

English Abstract and Machine Translation for Chinese Publication No. 1892049 A, published Jan. 10, 2007, 9 pgs.

* cited by examiner

FAN COVER HAVING VIBRATION SUPPRESSING MECHANISM OF FAN MOTOR, AND MOTOR DRIVE UNIT

BACKGROUND OF THE INVENTION

1. Field of the Invention

The present invention relates to a fan cover having a fan motor for cooling electronic parts. The present invention also relates to a motor drive unit including the fan cover.

2. Description of the Related Art

A motor drive unit is provided with a fan motor for cooling electronic parts arranged inside a drive unit. FIG. 8A is a perspective front view of a fan cover of the prior art. FIG. 8B is a perspective rear view of the fan cover of the prior art. As shown in FIG. 8A, the fan cover 100 has an opening portion 120 in which air passes from a fan motor (not shown in FIG. 8A). As shown in FIG. 8B, two protruding portions 130 for supporting the fan motor are arranged around the opening portion 120.

FIG. 8C is a side view of the fan cover of the prior art. As shown in FIG. 8C, the fan motor 110 is supported by two protruding portions 130 so that the fan motor 110 can face the opening portion 120.

Specifically, as shown in FIG. 8D, which is a partially enlarged view of FIG. 8C, the fan motor 110 is engaged with the supporting portion 140 located at an end portion of the protruding portion 130.

When the fan motor 110 is driven it vibrates, which is transmitted between the fan motor 110 and the fan cover 100. Further, the vibration is transmitted between the fan cover 100 and the main body case (not shown) for holding the fan cover 100. As a result, noise is generated and the reliability of parts of the motor drive unit may be deteriorated.

Therefore, according to the official gazette of JP-A-5168188, a vibration isolating rubber is arranged between the fan motor and the main body case so as to suppress the vibration of the fan motor.

However, in the case of the official gazette of JP-A-5168188, it is necessary to prepare the vibration isolating rubber. Accordingly, a number of parts increases and the production cost of the motor drive unit is raised. Further, since the vibration isolating rubber deteriorates with age, it takes time and labor to maintain the motor drive unit.

The present invention has been accomplished in view of the above circumstances. An object of the present invention is to provide a fan cover capable of suppressing vibration of the fan motor without using vibration isolating rubber and also provide a motor drive unit including such a fan cover.

SUMMARY OF THE INVENTION

In order to accomplish the above object, the first invention provides a fan cover on which a fan motor is mounted, comprising: a fan cover flat portion on which an opening portion is formed; a protruding portion extending from the fan cover flat portion around the opening portion; and a supporting portion, which is arranged in the protruding portion, for supporting the fan motor, wherein a distance between the fan cover flat portion and the supporting portion of the protruding portion is smaller than the thickness of the fan motor.

The second invention provides the fan cover according to the first invention, wherein at least one of the fan cover flat portion and the protruding portion is made of elastic material.

The third invention provides the fan cover according to the first invention, wherein at least one of the fan cover flat portion and the protruding portion is formed into a shape having elasticity.

The fourth invention provides the fan cover according to one of the first to the third invention, wherein a convex portion is arranged on a portion of the fan cover flat portion coming into contact with the fan motor.

The fifth invention provides the fan cover according to one of the first to the fourth invention, wherein a convex portion engaging with at least one of the holes formed in four corners of the fan motor is arranged on the fan cover flat portion.

The sixth invention provides the fan cover according to one of the first to the fifth invention, wherein a concave portion is formed on an upper face of the supporting portion.

The seventh invention provides a motor drive unit in which the fan cover according to one of the first to the sixth invention is mounted on the main body case.

These and other objects, characteristics and advantages of the present invention will become more apparent from detailed explanations of the typical embodiment of the present invention shown in the accompanying drawings.

DETAILED DESCRIPTION

Figure 1A:
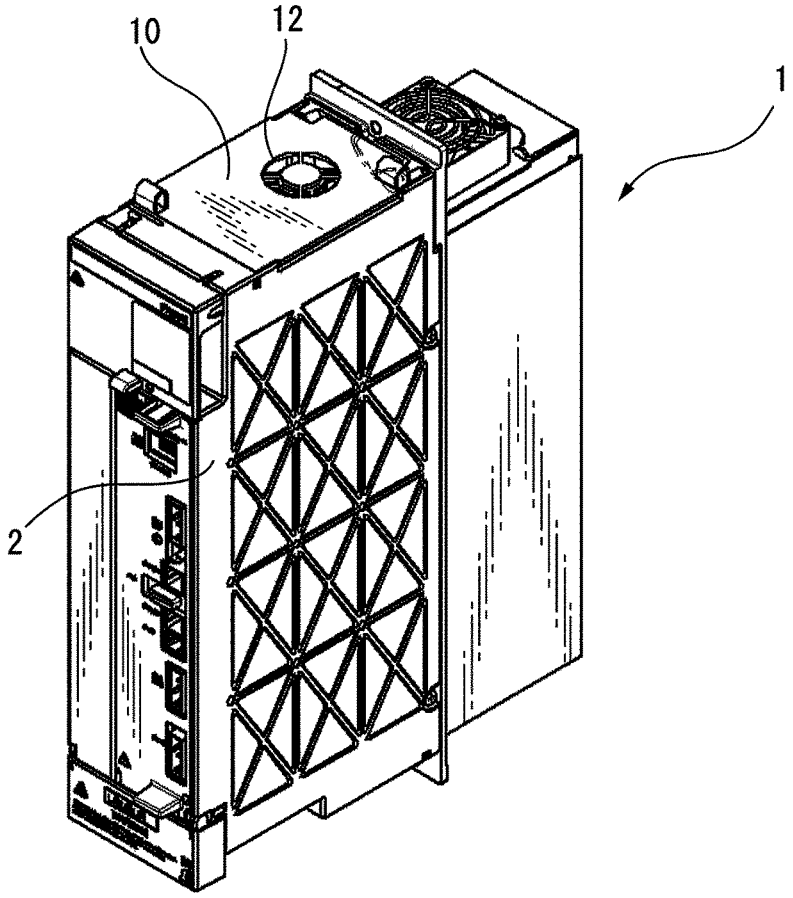
FIG. 1A is a perspective view of a motor drive unit on which a fan cover according to the present invention is mounted.

Referring to the accompanying drawings, embodiments of the present invention will be explained below. In the following drawings, like reference marks are used to indicate like components. In order to enhance understanding, the scale of the components of the embodiment shown in the drawings have been appropriately reduced.

Figure 1B:
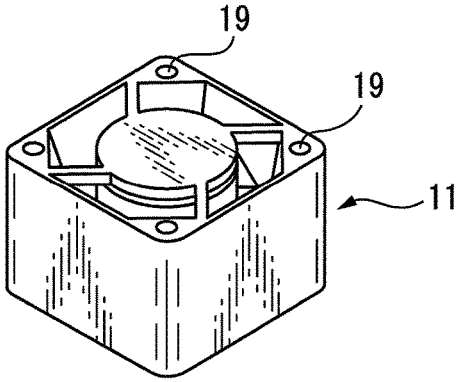
FIG. 1B is a perspective view of a fan motor.

FIG. 1A is a perspective view of a motor drive unit on which a fan cover according to the present invention is mounted. The motor drive unit 1 shown in FIG. 1A includes: a main body case 2 for accommodating electronic parts not shown in the drawing; and a fan cover 10 for closing one end of the main body case 2. The fan motor 11 shown in FIG. 1B is mounted on a rear face of the fan cover 10. Specifically, an upper end portion of the fan motor 11 comes into contact with a rear face of the fan cover 10 at a position of the opening portion 12 described later.

Figure 2A:
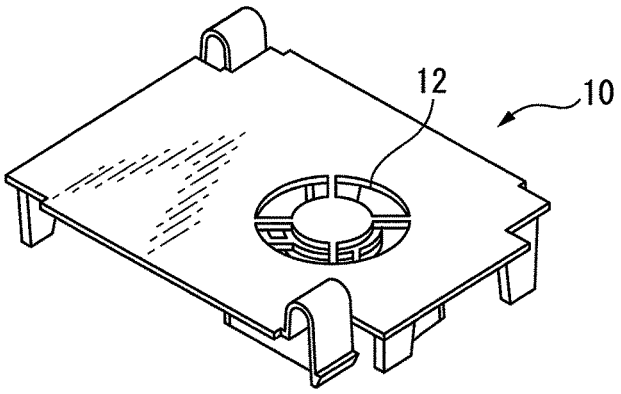
FIG. 2A is a perspective front view of the fan cover of the first embodiment of the present invention.
Figure 2B:
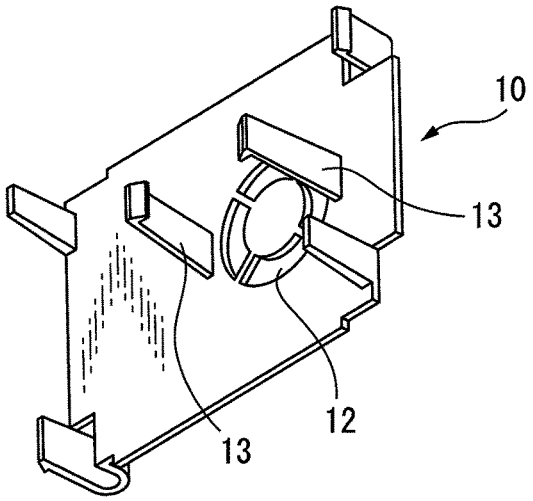
FIG. 2B is a perspective rear view of the fan cover shown in FIG. 2A.

FIG. 2A is a perspective front view of the fan cover of the first embodiment of the present invention. FIG. 2B is a perspective rear view of the fan cover shown in FIG. 2A. As shown in FIG. 2A, the opening potion, in which air passes through from the fan motor (not shown in FIG. 2A), is formed on a flat portion of the fan cover 10. As shown in FIG. 2A, four holes extending in the peripheral direction are formed in the opening portion 12. These four holes compose the substantially ring-shaped opening portion 12. As shown in FIG. 2B, two protruding portions 13 for supporting the fan motor are arranged around the opening portion 12 being opposed to each other.

Figure 2C:
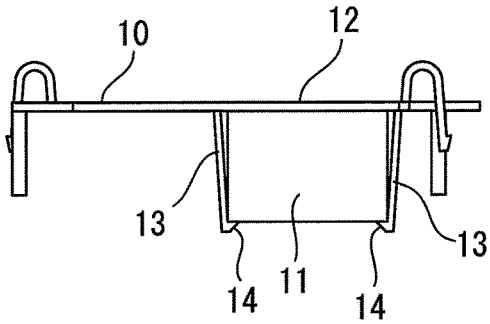
FIG. 2C is a side view of the fan cover of the first embodiment of the present invention.
Figure 2D:
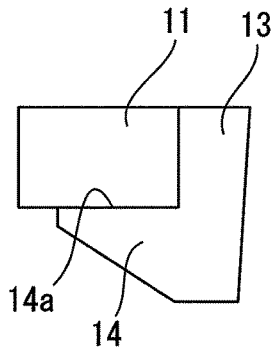
FIG. 2D is a partially enlarged view of FIG. 2C.

FIG. 2C is a side view of the fan cover of the first embodiment of the present invention. As shown in FIG. 2C, two protruding portions 13 are extended substantially perpendicularly with respect to the fan cover 10 from the rear face of the fan cover 10 being opposed to each other. As shown in FIG. 2D which is a partially enlarged view of FIG. 2C, the protruding portion 13 has a supporting portion 14, which is formed bent inward, for supporting the fan motor 11. The upper face 14*a* of the supporting portion 14 is mostly parallel with the flat portion of the fan cover 10. The supporting portion 14 of the protruding portion 13 partially overlaps an edge portion of the fan motor 11.

In the first embodiment, a distance between the rear face of the fan cover 10 and the upper face of the supporting portion 14 of the protruding portion 13 is smaller than the thickness (height in the axial direction) of the fan motor 11. At least one of the protruding portion 13 and the fan cover 10 is made of elastic material, for example, a resin material. Therefore, at the time of mounting the fan motor 11, the distance from the rear face of the fan cover 10 to the supporting portion 14 of the protruding portion 13 is temporarily enlarged. Accordingly, a lower end portion of the fan motor 11 is engaged with the respective supporting portions 14 of two protruding portions 13, so that the fan motor 11 can be pressed against the rear face of the fan cover 10.

Since two supporting portions 14 provide a pressing force to the fan motor 11, the fan motor 11 can be contacted with the rear face of the fan cover 10. Due to the foregoing, the fan motor 11 can be strongly supported on the fan cover 10. Therefore, even at the time of driving the fan motor 11, the generation of vibration of the fan motor 11 can be suppressed. Accordingly, vibration transmitted between the fan motor 11 and the fan cover 10 and between the fan cover 10 and the main body case 2 can be suppressed. Therefore, in the present invention, the generation of noise can be prevented and at the same time the reliability of parts of the motor drive unit 1 can be increased.

Figure 3A:
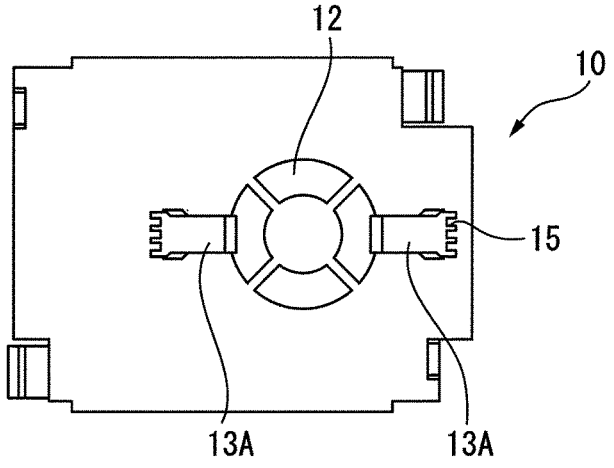
FIG. 3A is a rear view of the fan cover of the second embodiment of the present invention.
Figure 3B:
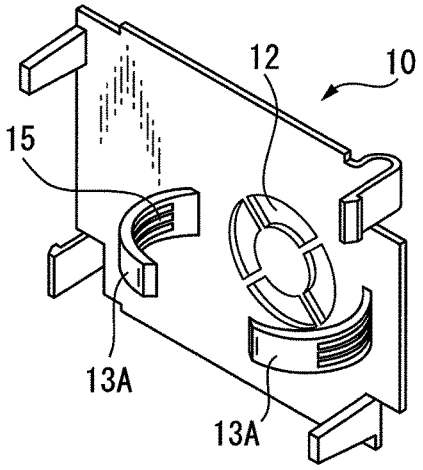
FIG. 3B is a perspective rear view of the fan cover shown in FIG. 3A.

FIG. 3A is a rear view of the fan cover of the second embodiment of the present invention. FIG. 3B is a perspective rear view of the fan cover shown in FIG. 3A. As shown in these drawings, two protruding portions 13A in the second embodiment of the present invention are extended from the flat portion of the fan cover 10 being curved in an arc shape in such a manner that two protruding portions 13A are opposed to each other. As can be seen from FIG. 3C, an end portion of the protruding portion 13A partially overlaps an edge portion of the fan motor 11.

As can be seen from FIGS. 3A and 3B, the protruding portion 13A has a plurality of slits 15 partially extending in the longitudinal direction of the protruding portion 13A. Therefore, even when the protruding portion 13A is made of hard material, the protruding portion 13A has elasticity. Accordingly, in the second embodiment, the protruding portion 13A can be bent. In this connection, the protruding portion 13A may be formed into another shape having elasticity. Alternatively, at least one of the protruding portion 13A and the fan cover 10 may be made of soft material. In this case, the slits 15 can be omitted.

In the second embodiment, the protruding portion 13A is curved. Therefore, the end portion of the protruding portion 13A is mostly parallel with the flat portion of the fan cover 10. Therefore, in the second embodiment, the end portion of the protruding portion 13A functions as a supporting portion 14. Alternatively, in the second embodiment, the supporting potion 14 may be excluded.

Figure 3C:
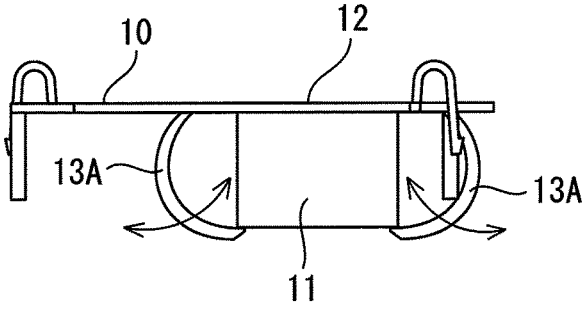
FIG. 3C is a side view of the fan cover of the second embodiment of the present invention.

FIG. 3C is a side view of the fan cover of the second embodiment of the present invention. As shown in FIG. 3C, at the time of mounting the fan motor 11, two protruding portions 13A are opened so that they move away from each other in the distance. Due to the foregoing, a distance between the end portions of two protruding portions 13A is increased. Then the fan motor 11 is inserted into a gap between two protruding portions 13A. After that, the protruding portions 13A are returned to the original positions.

Due to the foregoing, as shown in FIG. 3C, end portions of the protruding portions 13A support a lower end portion of the fan motor 11. Accordingly, the fan motor 11 is given a pressing force and made to come into contact with the rear face of the fan cover 10. Therefore, in the second embodiment, even when the distance between the fan cover 10 and the end portion of the protruding portion 13A is smaller than the thickness of the fan motor 11, the fan motor 11 can be appropriately supported. Therefore, it is possible to provide a similar advantage as previously described.

In this connection, in the case of the fan cover 10, a distance between the rear face of the fan cover 10 and the upper face 14*a* of the supporting portion 14 of the protruding portion 13 is larger than the thickness of the fan motor 11. In such a case, it is impossible to make the fan motor 11 come into contact with the fan cover 10 by the supporting portion 14 of the protruding portion 13. As a result, noise is generated. In the case described above, it is preferable that the distance between the rear face of the fan cover 10 and the upper face 14*a* of the supporting portion 14 of the protruding portion 13 is reduced according to the third and the fourth embodiment.

Figure 4A:
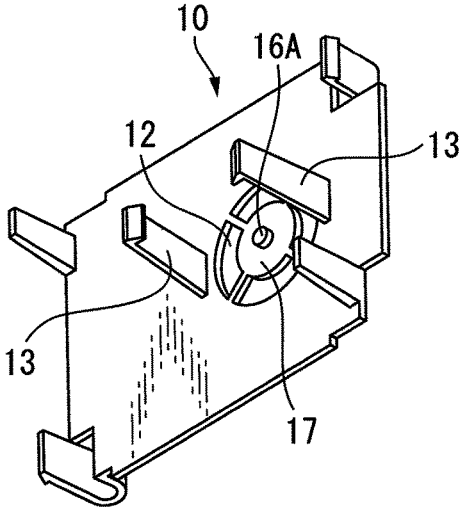
FIG. 4A is a perspective rear view of the fan cover of the third embodiment of the present invention.
Figure 4B:
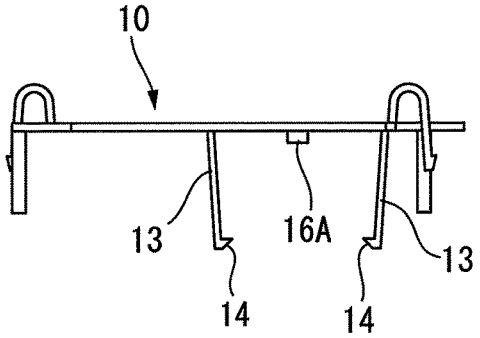
FIG. 4B is a side view of the fan cover shown in FIG. 4A.

FIG. 4A is a perspective rear view of the fan cover of the third embodiment of the present invention. FIG. 4B is a side view of the fan cover shown in FIG. 4A. In these drawings, the mostly same fan cover as that shown in FIGS. 2B and 2C is shown. In the third embodiment, the convex portion 16A is provided in the inside region 17 located inside of the opening 12. It is preferable that the convex portion 16A be made of an elastic material, for example, a resin material. The inside region 17 of the opening portion 12 is arranged at a position corresponding to the center of the fan motor 11.

Height of the convex portion 16A is determined according to the distance between the rear face of the fan cover 10 and the upper face 14*a* of the supporting portion 14 of the protruding portion and also according to the thickness of the fan motor 11. In other words, the height of the convex portion 16A is decided so that the distance between the end portion of the convex portion 16A and the upper face 14*a* of the supporting portion 14 of the protruding portion 13 can be smaller than the thickness of the fan motor 11.

As can be seen from FIGS. 4A and 4B, the convex portion 16A is provided on the rear face of the fan cover 10 on which the protruding portion 13 is provided. This convex portion 16A may be attached onto the existing fan cover 10 afterward.

In the case where the convex portion 16A is arranged as described above, when the fan motor 11 is mounted, the upper end of the fan motor 11 comes into contact with the convex portion 16A. Therefore, the fan cover 10 is a little deformed around convex portion 16A. Accordingly, while the supporting portion 14 of the protruding portion 13 is giving a pressing force to the fan motor 11, the fan motor 11 is fixed onto the rear face of the fan cover 10. Therefore, it is possible to provide a similar advantage as previously described. As described above, in the third embodiment, when the convex portion 16A is attached onto the existing fan cover 10, it is possible to strongly mount the fan motor 11 on the existing fan cover.

In this connection, some fan motors 11 are provided with a printed circuit board (not shown in the drawing) which is incorporated inside the fan motors at the center. Therefore, at the time of mounting the fan motor 11 on the fan cover 10, the printed circuit board of the fan motor 11 is given a load and possibly damaged. On the other hand, in the case of giving a load to a neighborhood of the upper end edge portion of the fan motor 11, the printed circuit board is not damaged. Accordingly, in the case of using some fan motors 11, it is preferable that the convex portion is arranged at a different position according to the fourth embodiment.

Figure 5A:
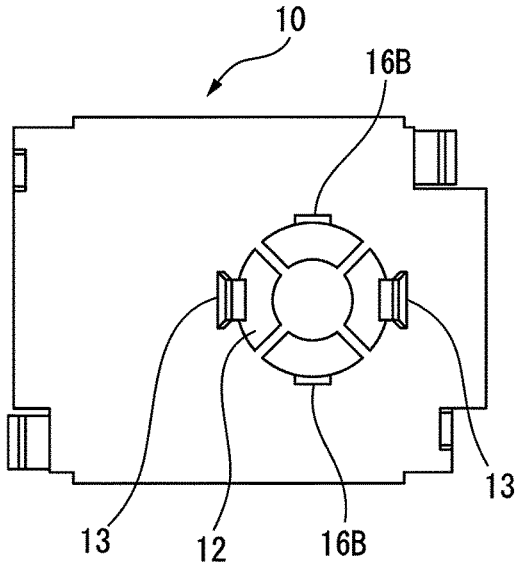
FIG. 5A is a front view of the fan cover of the fourth embodiment of the present invention.
Figure 5B:
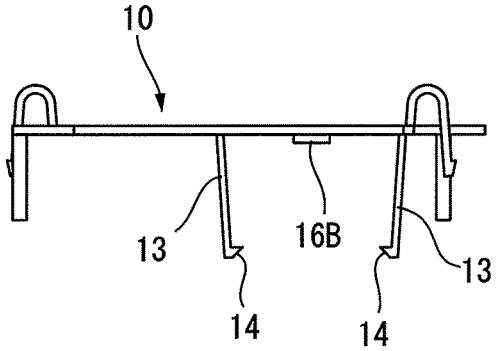
FIG. 5B is a side view of the fan cover shown in FIG. 5A.

FIG. 5A is a front view of the fan cover of the fourth embodiment of the present invention. FIG. 5B is a side view of the fan cover shown in FIG. 5A. In the fourth embodiment, the convex portions 16B partially extending along the outer periphery of the opening portion 12 are arranged on the flat portion of the fan cover 10. It is preferable that the convex portions 16B be made of an elastic material, for example, a resin material.

As shown in FIGS. 5A and 5B, two convex portions 16B are arranged on the rear face of the fan cover 10 being opposed to each other. These convex portions 16B may be attached to the existing fan cover 10 afterward.

In this connection, more convex portions 16B may be arranged. As can be seen from FIG. 5A, it is preferable that a plurality of convex portions 16B and two protruding portions 13 are arranged at regular intervals in the peripheral direction of the opening portion 12. In this connection, the heights of the convex portions 16B are decided in the same manner as the convex portion 16A previously described. In this connection, the heighst of the convex portions 16B are not necessarily flat and constant but the convex portions 16B may be inclined.

In the case where a plurality of convex portions 16B are arranged as described above, when the fan motor 11 is mounted, an upper end of the fan motor 11 comes into contact with the convex portions 16B. Therefore, portions of the fan cover 10 around the plurality of convex portions 16B have little deformation.

Accordingly, while the supporting portion 14 of the protruding portion 13 is giving a pressing force to the fan motor 11, the fan motor 11 is fixed onto the rear face of the fan cover 10. Therefore, it is possible to provide a similar advantage as previously described.

In the fourth embodiment, a plurality of convex portions 16B are arranged along the outer periphery of the opening portion 12. Therefore, it is possible to avoid applying a load to a printed circuit board, which is incorporated in the center of the fan motor 11. As result, damage to the printed circuit board can be prevented.

In this connection, referring to FIG. 1B again, four fixing holes 19 are formed at four corners of the upper end of the fan motor 11. These fixing holes 19 are usually used for fixing the fan motor 11 to a plate, which is not shown in the drawing, by screwing. As explained in the fifth embodiment, these fixing holes 19 may be used when the fan motor 11 is fixed by another method.

Figure 6A:
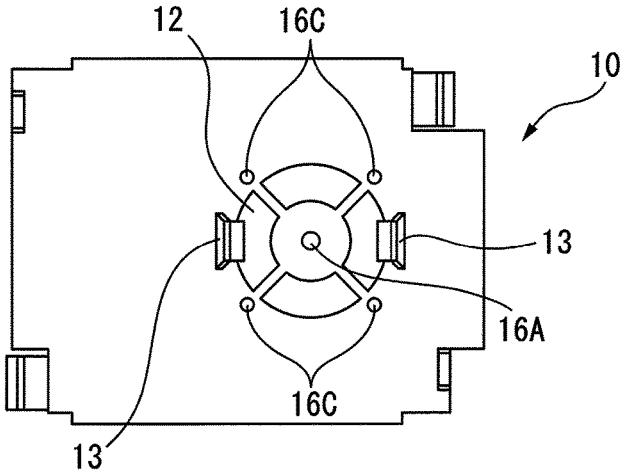
FIG. 6A is a rear view of the fan cover of the fifth embodiment of the present invention.
Figure 6B:
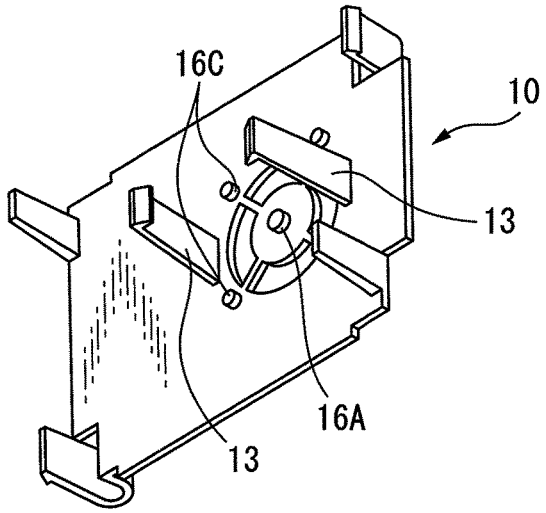
FIG. 6B is a perspective rear view of the fan cover shown in FIG. 6A.
Figure 6C:
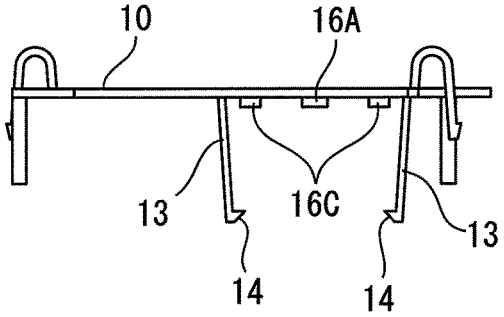
FIG. 6C is a side view of the fan cover shown in FIG. 6A.

FIG. 6A is a rear view of the fan cover of the fifth embodiment of the present invention. FIG. 6B is a perspective rear view of the fan cover shown in FIG. 6A. FIG. 6C is a side view of the fan cover shown in FIG. 6A. In these drawings, the convex portion 16A is arranged at the center of the inside region 17 of the opening portion 12. Further, in the fifth embodiment, four convex portions 16C are arranged around the opening portion 12.

It is preferable that these convex portions 16C are made of the same material as the convex portion 16A. Sizes and positions of these convex portions 16C correspond to the sizes and positions of the fixing holes 19 of the fan motor 11. In this connection, four convex portions 16C are shown in FIGS. 6A and 6B, however, it is sufficient that at least one convex portion 16C is provided corresponding to the fixing hole 19 of the fan motor 11. In the fifth embodiment, the convex portion 16A may be omitted.

In the case where a plurality of convex portions 16C are arranged, the fixing holes 19 at the upper end of the fan motor 11 are respectively engaged with the plurality of convex portions 16C. Accordingly, the fan motor 11 can be accurately positioned in the longitudinal direction and the lateral direction of the fan cover 10.

In general, when the supporting portion 14 of the protruding portion 13 gives a pressing force to the fan motor 11, the fan motor 11 tends to slip out of the place. However, in the fifth embodiment, the convex portions 16C are engaged with the fixing holes 19 of the fan motor 11. Therefore, even when force is applied to the fan motor 11, the fan motor 11 does not slip out of position. Accordingly, it is possible to fix the fan motor 11 at an accurate position on the rear face of the fan cover 10.

Figure 7:
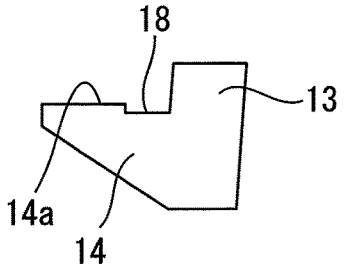
FIG. 7 is a partially enlarged view of FIG. 6C.
Figure 8A:
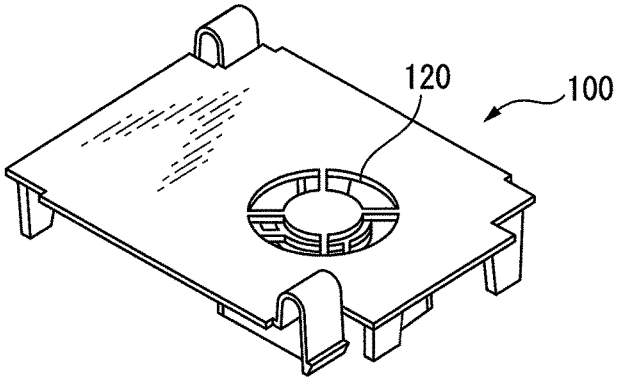
FIG. 8A is a perspective front view of the fan cover of the prior art.
Figure 8B:
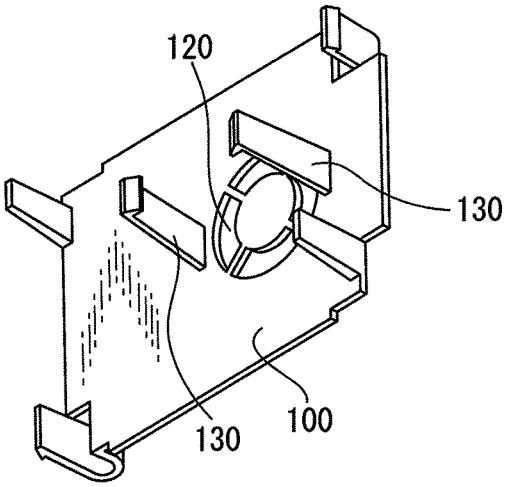
FIG. 8B is a perspective rear view of the fan cover of the prior art.
Figure 8C:
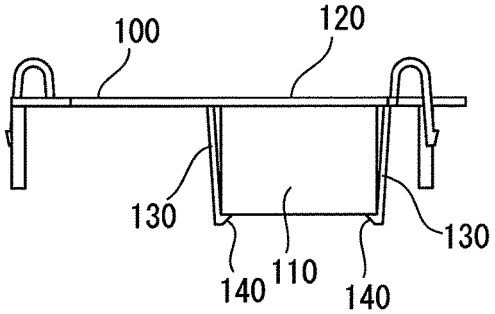
FIG. 8C is a side view of the fan cover of the prior art.
Figure 8D:
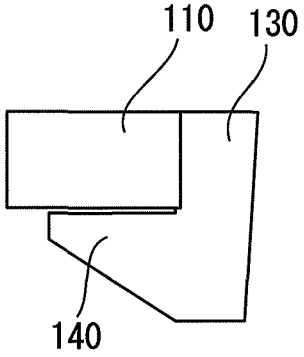
FIG. 8D is a partially enlarged view of FIG. 8C.

In this connection, when a pressing force is applied to the fan motor 11, the fan cover 10 is deformed and the fan motor 11 is moved away from the supporting portion 14 of the protruding portion 13 in some cases. Accordingly, as shown in FIG. 7 which is an enlarged view of the FIG. 6C, the concave portion 18 is formed on an upper face 14*a* of the supporting portion 14. As shown in FIG. 7, it is preferable that the concave portion 18 is formed in a portion of the upper face 14*a* of the supporting portion 14 that is close to the protruding portion 13. In the case described above, when the fan cover 10 is deformed by a pressing force, a lower end of the fan motor 11 is caught by the concave portion 18 of the supporting portion 14. Therefore, even when the fan motor 11 is given a pressing force, the fan motor 11 does not move away from the supporting portion 14 of the protruding portion 13.

However, when the depth of the concave portion 18 is large, a distance between the convex portions 16A, 16B of the fan cover 10 and the supporting portion 14 of the protruding portion 13 exceeds the thickness of the fan motor 11 in some cases. In the case described above, it is impossible to give a pressing force to the fan motor 11. Accordingly, in the case where the concave portion 18 is provided, it is necessary that a distance between the convex potions 16A, 16B of the fan cover 10 and the bottom portion of the concave portion 18 of the supporting portion 14 of the protruding portion 13 is maintained smaller than the thickness of the fan motor 11. In this connection, some appropriate combinations of the above embodiments are included in the scope of the present invention.

Advantages of the Present Invention

In the first embodiment, a distance between the fan cover flat portion and the supporting portion of the protruding portion is smaller than the thickness of the fan motor. Therefore, the protruding portion can strongly support the fan motor on the fan cover. Accordingly, no gap is formed between the fan motor and the fan cover. Therefore, vibration generated at the time of driving the fan motor can be suppressed. Accordingly, vibration transmitted between the fan motor and the fan cover can be suppressed. In other words, since vibration of the fan motor can be suppressed without using a piece of vibration isolating rubber, the generation of noise can be prevented and the production cost can be reduced.

In the second embodiment, at the time of mounting the fan motor, a distance between the rear face of the fan cover and the supporting portion of the protruding portion can be temporarily extended.

In the third embodiment, even in the case where a distance between the fan cover and the protruding portion is smaller than the thickness of the fan motor, it is possible to appropriately support the fan motor.

In the fourth embodiment, when convex portions are locally attached onto the existing fan cover, the fan motor can be strongly mounted even on the existing fan cover.

In the fifth embodiment, when the convex portions are engaged with the fixing holes formed at four corners of the fan motor, it is possible to position the fan motor in the longitudinal and the lateral direction.

In the sixth embodiment, when the fan cover is deformed being given a pressing force, it is possible to avoid the occurrence of a problem of moving the fan motor away from the supporting portion of the protruding portion.

In the seventh embodiment, it is possible to suppress vibration transmitted between the fan cover and the main body case and it is also possible to increase the reliability of the parts of the motor drive unit.

The present invention has been explained above using typical embodiments. A person skilled in the art will be able to understand that the aforementioned changes, other various changes, omissions and additions can be executed without departing from the scope of claim of the present invention.

The invention claimed is:

1. A fan cover on which a fan motor is mounted, the fan motor having a first surface and a second surface opposite the first surface, the cover comprising: a fan cover flat portion in which an opening portion is formed, the opening portion remaining open when the fan motor is mounted on the fan cover so that air passes through the opening portion from the fan motor; two protruding portions having a proximal end coupled to the flat portion around the opening portion, the two protruding portions extending from the fan cover flat portion, each of the two protruding portions having a supporting portion located at a distal end of each protruding portion for supporting the fan motor, wherein one or two convex portions are arranged on a portion of the fan cover flat portion wherein the one or two convex portions come into contact with the first surface of the fan motor, wherein the one or two convex portions are arranged on a line equidistant between the proximal ends of the two protruding portions, wherein the fan motor is supported between an end portion of the one or two convex portions and an upper face of each of the supporting portions so that the end portion of the one or two convex portions contacts the first surface of the fan motor and the supporting portion of each of the two protruding portions contacts the second surface of the fan motor.

2. The fan cover according to claim 1, wherein a concave portion is formed on the upper face of the supporting portion.

3. A motor drive unit, on a main body case of which the fan cover according to claim 1 is mounted.

4. The fan cover according to claim 1, wherein the supporting portion supports an end surface of the fan motor.

* * * * *